US007197787B2

(12) United States Patent
Sehestedt

(10) Patent No.: US 7,197,787 B2
(45) Date of Patent: Apr. 3, 2007

(54) HANG-ON MOP WRINGER

(76) Inventor: John H. Sehestedt, P.O. Box 178, 143 S. 200 W., Emery, UT (US) 84522

( * ) Notice: Subject to any disclaimer, the term of this patent is extended or adjusted under 35 U.S.C. 154(b) by 139 days.

(21) Appl. No.: 11/089,979

(22) Filed: Mar. 26, 2005

(65) Prior Publication Data

US 2005/0210618 A1 Sep. 29, 2005

Related U.S. Application Data

(60) Provisional application No. 60/556,786, filed on Mar. 29, 2004.

(51) Int. Cl.
*A47L 13/58* (2006.01)

(52) U.S. Cl. ..... 15/263; 15/260

(58) Field of Classification Search ..... 15/260, 15/263

See application file for complete search history.

(56) References Cited

U.S. PATENT DOCUMENTS 1,177,681 A * 4/1916 Christensen ..... 15/263
1,748,756 A * 2/1930 Cutler ..... 15/263
1,886,184 A * 11/1932 Heber ..... 15/263
1,952,824 A * 3/1934 Schulman ..... 15/263
2,171,387 A * 8/1939 Cleaveland ..... 15/263
4,735,332 A * 4/1988 Thumser ..... 220/735
5,414,892 A * 5/1995 Clark, Jr. ..... 15/263
6,823,557 B2 * 11/2004 Dingert ..... 15/260

FOREIGN PATENT DOCUMENTS

| | | | |
|---|---|---|---|
| DE | 2036622 | * | 2/1971 |
| DE | 19503572 | * | 7/1996 |
| EP | 910983 | * | 9/1998 |
| GB | 2189384 | * | 10/1987 |
| WO | 92/21276 | * | 12/1992 |

* cited by examiner

*Primary Examiner*—Mark Spisich
(74) *Attorney, Agent, or Firm*—Marcus G. Theodore

(57) ABSTRACT

A wall-supported conical wringer for round-based string mops and method of making said wringer is provided with some new features integrated into a special mounting system which permits the conical wringer to be attached and held in a usable position at any kitchen twin sink divider or can be used on a utility or washroom sink sidewall. The device provides a convenient means of removing the excess water from a water-soaked mop without the need of a wringer equipped mop bucket.

14 Claims, 5 Drawing Sheets

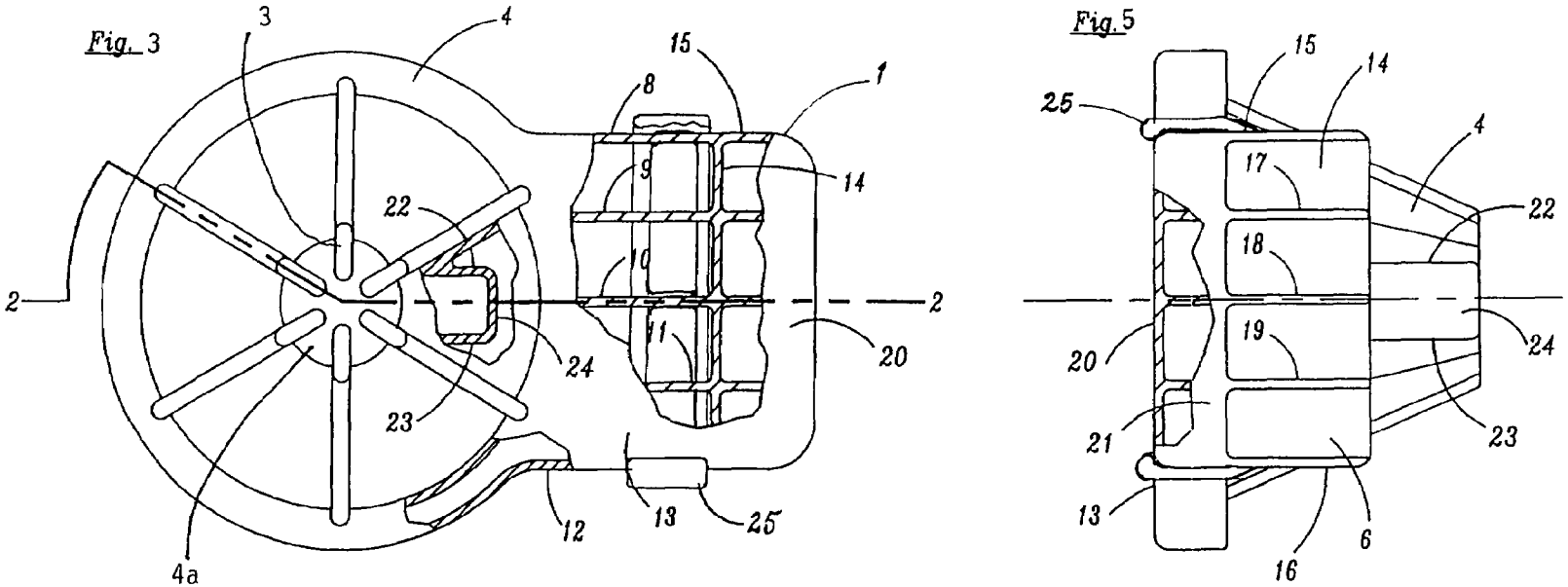
Fig. 3
Fig. 5
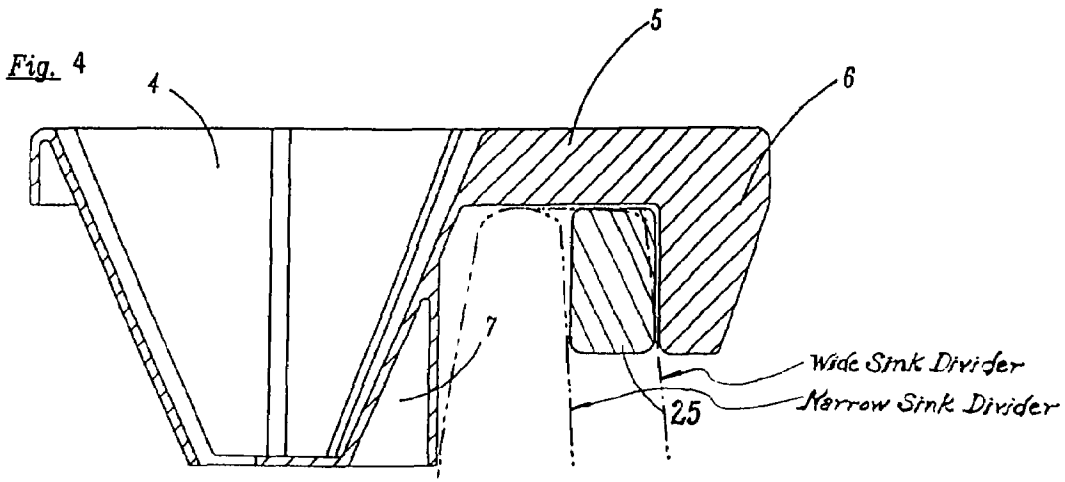
Fig. 4

HANG-ON MOP WRINGER

RELATED APPLICATIONS

This application is a continuation-in-part application of the provisional patent application entitled "Hang-On Mop Wringer", Ser. No. 60/556,786 filed Mar. 29, 2004.

BACKGROUND OF THE INVENTION

1. Field

This invention pertains to mop wringers. In particular it pertains to a mop wringer, which can hang on the divider in the kitchen sink or on the wall of other utility or washroom sink stationary receptacles, where it can be used to wring the excess water from a round-based string type mop.

2. State of the Art

A number of mop wringers are known. U.S. Pat. No. 3,406,422, MOP WRINGER, and U.S. Pat. No. 4,525,892, PAIL COVER HAVING MOPWRINGER, provide mop wringer devices, which are conical in form. Although water removal is accomplished by operator force, the application is different. Both these devices are applied in accompaniment with separate water receiving receptacles, specifically, buckets or pails, portable receptacles.

They are not adapted to mount on sink dividers and other utility or washroom sink sidewalls. Further, their conical elements are difficult to manufacture, and impede water escape. The device described below provides a device, which is less costly, and wrings out round-based string type mops more efficiently into a kitchen sink, or other utility or washroom sink for ease of disposal and rinsing.

SUMMARY OF THE INVENTION

The invention comprises a method of construction of/and a mop wringer having a conical wringer with an open rim end adapted to accommodate the head of a round string mop. The open rim leads into a conical compression chamber having drain holes in the bottom end of the compression chamber. As a user forces the head of the mop into the compression chamber, with downward twisting force, water is squeezed out of the mop head through the drain grooves and bottom drain holes. It has an integral extended hanger mounting bracket with a hooked rear mounting foot to removably mount and suspend the mop wringer onto a sink divider or wall of a utility or washroom sink. A snap-on spacer may be included to reduce the distance between the mounting bracket and rear mounting foot to accommodate and secure to thinner sink divider and/or other utility or washroom sink walls.

The mop wringer, when positioned to hang from any sink divider or other utility or washroom sink sidewall, is rigidly secured thereto to drain excess water from water-soaked round-based string mops into the sink or other utility or washroom sink for disposal. It securely positions the device in a desired accessible location and orientation for use. Thus mounted, it fully absorbs the mop twisting torque, which is encountered during use. When mopping is completed, it is readily removed for storage and reuse.

Preferably, the rim thickness of the conical wringer is twice the height and width of the wall thickness of the conical section for strength needed during the downward and twisting force, which occurs during use. Typically, the wall thickness of the conical section of the said conical wringer is approximately 0.100 plus/minus 0.02 inches if molded via plastic injection to reduce costs and reduce cooling time.

The inside surface of the conical mop wringer may include equally spaced slanting longitudinal drain grooves to assist in water removal. The drain grooves provide additional means for water escape. The drain grooves are cheaper to manufacture than including additional holes in the sidewalls of the conical compression chamber. These drain grooves preferably run the length of the inside surface of the conical wringer and are as wide as the thickness of the walls of the conical wringer, which are approximately one-eighth inch. The open longitudinal curvature shapes of these drain grooves also add strength to the walls of the conical compression chamber as corrugated reinforcing ribs.

The bottom of the conical wringer is preferably flat and has a diameter of approximately one-half the length of the conical compression chamber. Preferably, the flat bottom is equipped with six equally spaced exit drain holes. In the preferred embodiment, the drain holes are oblong in shape and are positioned such that one end of each is directly below one of each of the vertical drain grooves. The length of each drain hole is preferably approximately three times the width with the length of each oriented radially. Alternatively, the width of the drain holes may be the same as the width of the vertical drain grooves.

The main structural member of the said hanger mounting bracket is a hanger mounting bracket arm, which preferably is approximately three-quarter inch thick to withstand tensile, shear, and bending forces without cracking or failure during normal use. The securing surfaces of the hanger mounting bracket foot and outer surface of the mop compression chamber hold the device in position to withstand shear and bending forces, which occur during use. An additional side-of-cone stabilizer pad may be included to hold the device horizontally against vertical support dividers during use and adds stability and rigidity.

The preferred method for making the hang-on mop wringer is injection molding of the unit. It comprises the steps of: designing and building mold tooling; selecting plastic injection material; selecting injection parameters; and finishing of parting lines and flash. The preferred material used for construction is any standard plastic, nylon, or polymer normally used in the industry for such applications where a reasonable degree of strength is required.

DESCRIPTION OF THE DRAWINGS

FIG. 3 is a top cutaway view of the invention of FIG. 1

FIG. 4 is a side sectional view of the invention shown in FIG. 1.

FIG. 5 is rear sectional view of the invention shown in FIG. 1.

DESCRIPTION OF THE ILLUSTRATED EMBODIMENTS

Figure 1:
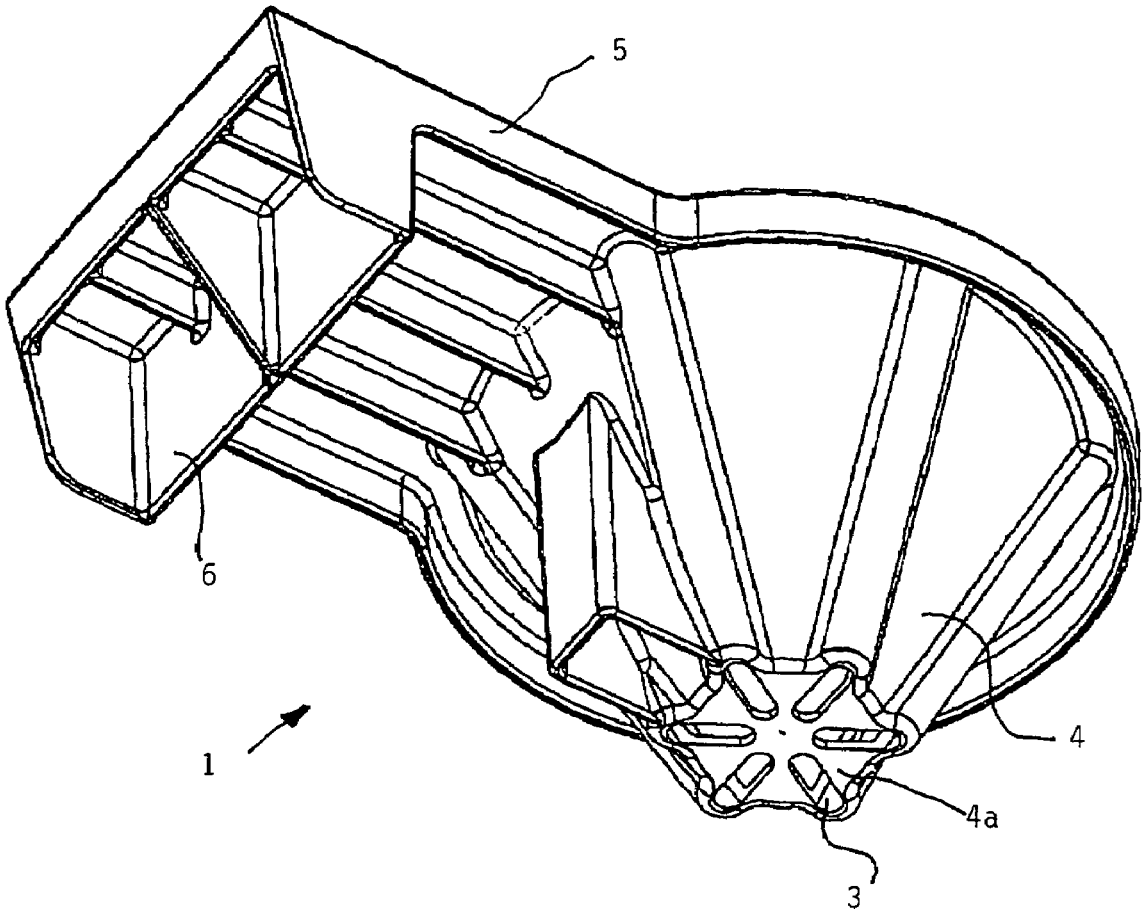
FIG. 1 is a bottom perspective view of the invention.
Figure 2:
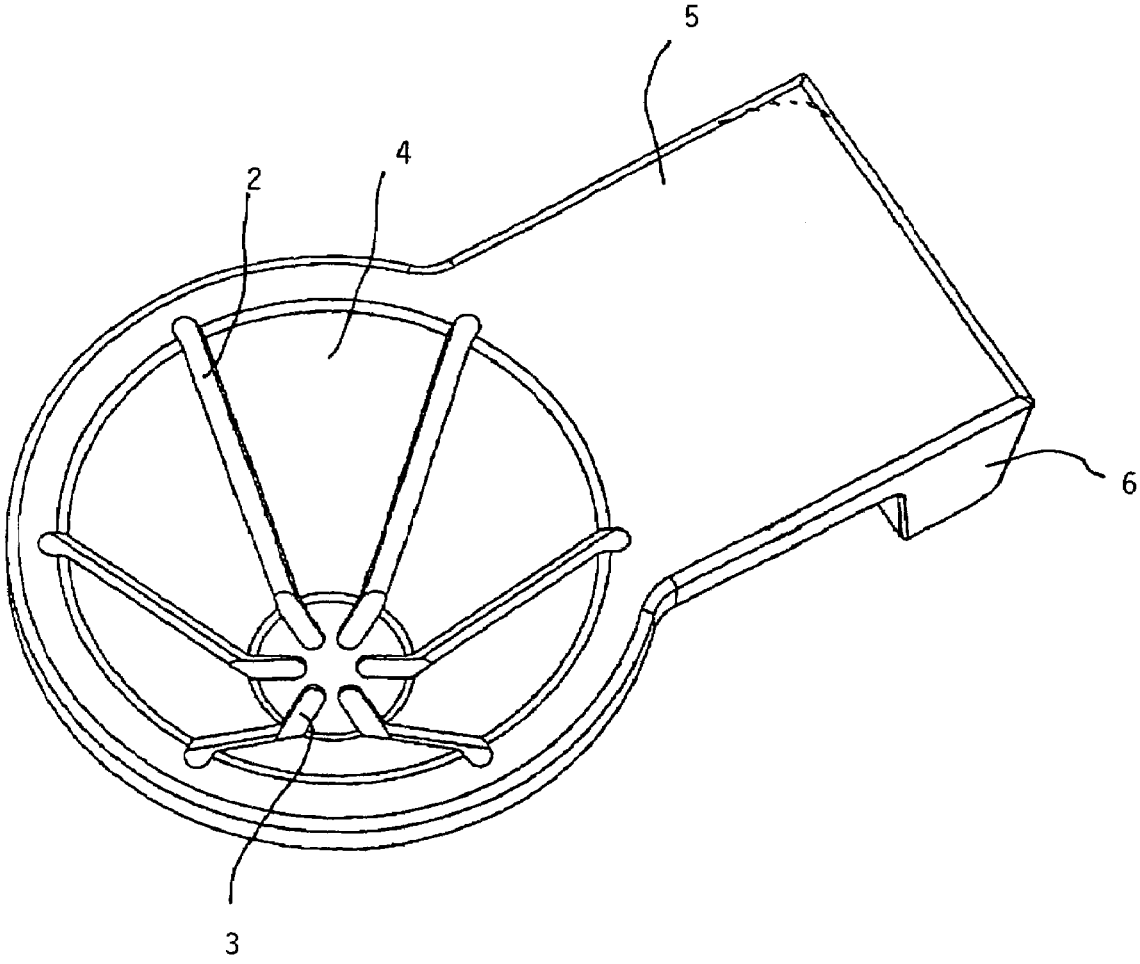
FIG. 2 is a top perspective view of the preferred embodiment of FIG. 1.

FIG. 1 is a bottom perspective view of a preferred embodiment of unibody construction of the mop wringer invention 1 made of injection molded nylon or plastic with reduced wall thickness. FIG. 2 is a top perspective view of the preferred embodiment of FIG. 1. This design allows for faster, greater ease, and less expense in its manufacture by plastic injection molding. This preferred design has a larger diameter conical compression chamber to accommodate larger mop heads. Ribbed reinforcing structure is incorporated to reduce weight while retaining necessary strength. It also includes a snap-on spacer clip to allow proper fit on both narrow and wide sink dividers.

The labeled components of the invention 1 shown in the drawings are:

2. Drain Grooves
3. Drain Holes
4. Conical Compression Chamber
4*a*. Bottom of Conical Compression Chamber
5. Hanger Mounting Bracket with
6. Hooked Rear Mounting Foot
7. Stabilizer Foot Pad
8. Right Outer Hanger Mounting Bracket Rib
9. Right Intermediate Hanger Mounting Bracket Rib
10. Mid Hanger Mounting Bracket Rib
11. Left Intermediate Hanger Mounting Bracket Rib
12. Left Outer Hanger Mounting Bracket Rib
13. Top of Hanger Mounting Bracket
14. Mounting Foot Face Wall
15. Right Outer Mounting Foot Rib
16. Left Outer Mounting Foot Rib
17. Right Intermediate Mounting Foot Rib
18. Mid Mounting Foot Rib
19. Left Intermediate Mounting Foot Rib
20. Top of Mounting Foot
21. Mounting Foot Rear Wall
22. Right Conical Compression Chamber Support Foot Rib
23. Left Conical Compression Chamber Support Foot Rib
24. Conical Compression Chamber Support Foot Face
25. Clip-On Spacer Attachment FIG. 2 is a top perspective view of the invention shown in FIG. 1. It shows the relative width and length of the rim of the conical compression chamber 4 and its attached hanger mounting bracket 5 and its mounting foot 6. The mounting bracket 5 is attached to the conical compression chamber 4 with six longitudinal drain grooves 2 in its walls. The wall thickness of the conical compression chamber is approximately 0.100 plus/minus 0.02 inches. The drain grooves 2 run lengthwise down the inside surface of the conical compression chamber 4 and direct water collected therein to exit through drain holes 3 passing through its flat bottom base 4*a* immediately below the grooves 2. There are six equally spaced exit drain holes 3. The drain holes 3 are oblong in shape and are radially spaced and positioned such that each is directly below a drain groove 2. The length of each drain hole 3 is approximately three times its width, with the length of each oriented radially.

FIG. 3 is a side sectional view showing the conical compression chamber 4, with attached connecting hanger mounting bracket 5 and its mounting foot 6. It shows the position of the conical compression chamber 4 stabilizer footpad 7, which positions the device securely against a vertical planer support surface, such as a sink divider. To reinforce the hanger mounting bracket 5, a right outer hanger mounting bracket rib 8, a right intermediate hanger mounting bracket rib 9, a mid hanger mounting bracket rib 10, a left intermediate hanger mounting bracket rib 11 and a left outer hanger mounting bracket rib 12 are included. These ribs 8, 9, 10, 11 and 12 are located beneath the top 13 of the hanger mounting bracket 5. To reinforce the conical compression chamber 4, a stabilizer foot pad 7 adds reinforcement as well as stability. It has rib reinforcement comprising: a right outer mounting foot rib 15, a left outer mounting foot rib 16, a right intermediate mounting foot rib 17, a mid mounting foot rib 18, and a left intermediate mounting foot rib 19. These are located beneath the top 20 of the hanger mounting bracket 5 proximate the mounting foot rear wall 21.

Shown in FIG. 3 is a clip-on spacer 25 to adjust the attachment spacing of the hanger mounting bracket 5 when mounted on a sink divider or other utility or washroom sink sidewall.

FIG. 4 is a rear view of the invention 1 showing the right outer mounting foot rib 15, the left outer mounting foot rib 16, the right intermediate mounting foot rib 17, the mid mounting foot rib 18, and the left intermediate mounting foot rib 19. To further reinforce the stabilizer foot pad 7 rear wall 21, a right conical compression chamber support foot rib 22, and a left conical compression chamber support foot 23 are included as shown in FIG. 4.

Figure 6:
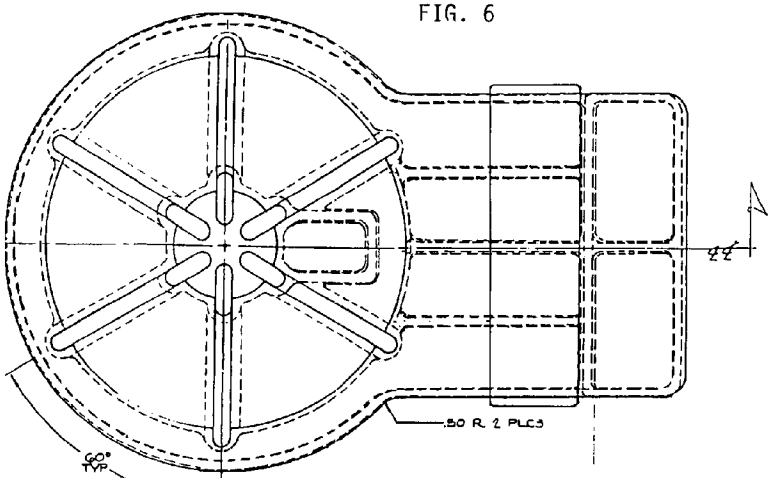
FIG. 6 is another top view of the invention of FIG. 3.

FIG. 6 is another top view of the invention of FIG. 3 with hidden lines showing the part extensions.

Figure 7:
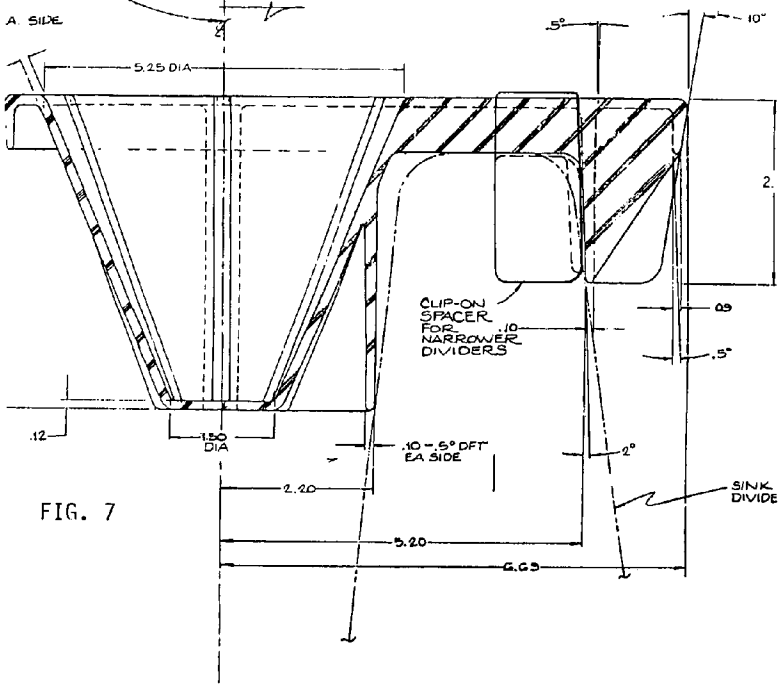
FIG. 7 is another side sectional view of the invention of FIG. 4.

FIG. 7 is another side sectional view of the invention of FIG. 4 with hidden lines also shown the part extensions.

Figure 8:
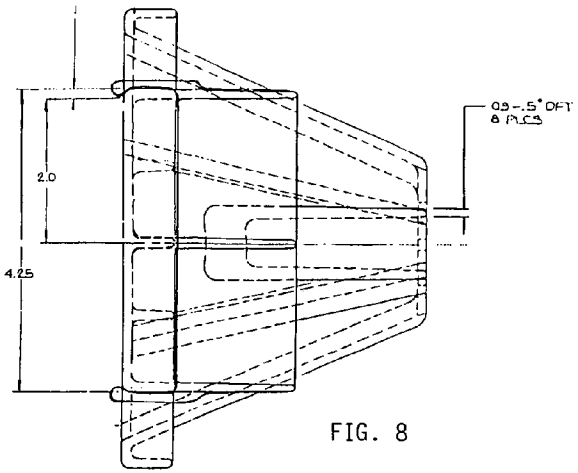
FIG. 8 is another rear sectional view of the invention of FIG. 5.

FIG. 8 is another rear sectional view of the invention of FIG. 5 with hidden lines showing the part extensions.

Figure 9:
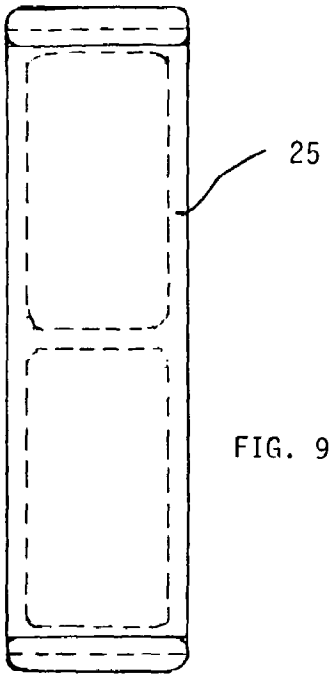
FIG. 9 is a top view of a preferred clip on spacer.

FIG. 9 is a top view of a preferred clip on spacer 25 showing its preferred ribbed construction in hidden lines.

Figure 10:
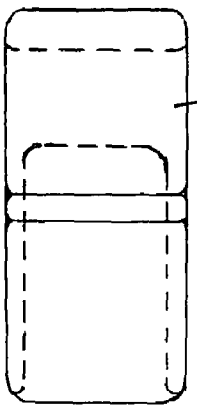
FIG. 10 is a side view of the preferred clip on spacer of FIG. 9.

FIG. 10 is a side view of the preferred clip on spacer 25 of FIG. 9.

Figure 11:
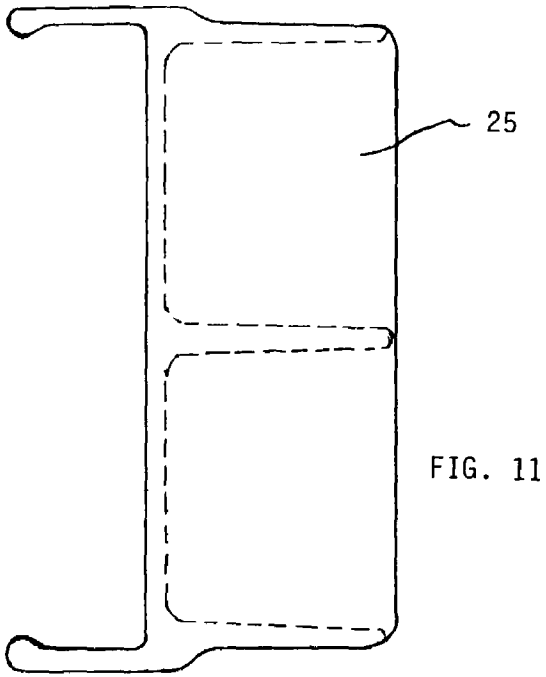
FIG. 11 is a rear view of the preferred clip on spacer of FIG. 9.

FIG. 11 is a rear view of the preferred clip on spacer 25 of FIG. 9.

The invention thus provides a single piece conical mop wringer 1 with no moving parts, which can hang on various sized sink divider, or other utility or washroom sink sidewalls. It has a hanger mounting bracket 5 with mounting foot 6, which grasps vertical support walls to hold the entire device in position. The conical mop wringer 1 removes excess water from string type mops by a user inserting a mop head therein and exerting a downward twisting force. The inside surface drain grooves 2 of the conical mop wringer 1 direct water to exit through drain holes 3 beneath the drain grooves 2.

Although this description has referred to illustrated embodiments, it is not intended to restrict the scope of the claims. The claims themselves recite those features deemed essential to the invention.

I claim:

1. A mop wringer comprising:

a. a conical wringer with
   i. an open rim adapted to accommodate the head of a round string mop, and
   ii. a conical compression chamber with sloping sidewalls having an open top and bottom, the open top attached to and in communication with the conical wringer open rim, and the bottom having drain holes such that as a user forces the head of the mop into the compression chamber water is squeezed out of the mop head through the drain holes, b. an integral extended hanger mounting bracket with a front attached proximate the rim of the conical wringer and a hooked rear mounting foot structured to removably mount onto and suspend the mop wringer from a sink divider or wall of a utility or washroom sink between the front and the rear mounting foot, and c. a snap-on spacer slideably attached to the mounting bracket between the front and rear mounting foot to reduce the distance between the front and the spacer for the bracket to mount on thinner sink divider, and/or utility or washroom sink walls between the front and spacer for a more secure mounting.

2. A mop wringer according to claim 1, wherein the bottom of the conical wringer is preferably flat and has a diameter approximately one-half the length of the conical compression chamber of the conical wringer.

3. A mop wringer according to claim 1, including a plurality of equally spaced drain grooves along the inside surface of the conical mop wringer compression chamber sloping sidewalls, which act as reinforcing corrugated ribs and assist in water removal by providing additional drainage surface channels when the user wrings the head of a mop within the compression chamber.

4. A mop wringer according to claim 3, wherein each drain groove drains into a corresponding drain hole.

5. A mop wringer according to claim 4, wherein the drain holes have a length and width and are oblong in shape.

6. A mop wringer according to claim 5, wherein the length of each drain hole is preferably approximately three times its width with the length of each oriented radially.

7. A mop wringer according to claim 5, wherein the width of the drain holes is the same as the width of the drain grooves.

8. A mop wringer according to claim 1, including reinforcing structure associated with the mounting bracket securing surfaces and the outer surface of the mop compression chamber to hold the mop wringer in a position to withstand shear and bending forces, which occur during use.

9. A mop wringer according to claim 8, including additional side-of-cone stabilizer pads affixed to the exterior of the compression chamber to hold the mop wringer horizontally during use for added stability and rigidity.

10. A mop wringer comprising:

a. a conical wringer with a. an open rim adapted to accommodate the head of a round string mop, and b. a conical compression chamber with sloping sidewalls having an open top and bottom, the open top attached to and in communication with the conical wringer open rim, the sidewalls defining a plurality of equally spaced drain grooves along the inside surface of the conical mop wringer compression chamber sloping sidewalls to reinforce the sidewalls and assist in water removal, and the bottom having corresponding drain holes aligned beneath the drain grooves along the inside surface of the conical mop wringer compression chamber sloping sidewalls wherein the bottom of the conical wringer is preferably flat and has a diameter approximately one-half the length of the conical compression chamber of the conical wringer, such that as a user forces the head of the mop into the compression chamber water is squeezed out of the mop head through the drain holes, c. an integral extended hanger mounting bracket with a front attached proximate the rim of the conical wringer and a hooked rear mounting foot structured to removably mount onto and suspend the mop wringer from a sink divider or wall of a utility or washroom sink between the front and the rear mounting foot and d. a snap-on spacer slideably attached to the mounting bracket between the front and rear mounting foot to reduce the distance between the front and the spacer for the bracket to mount on thinner sink divider, and/or utility or washroom sink walls between the front and spacer for a more secure mounting.

11. A mop wringer according to claim 10, including reinforcing ribs associated with the mounting bracket securing surfaces and the outer surface of the mop compression chamber to hold the mop wringer in a position to withstand shear and bending forces, which occur during use.

12. A mop wringer according to claim 11, wherein mop wringer is injection molded of a unibody construction made of nylon or plastic with just sufficient conical sidewall thickness to withstand wringer forces incurred during use.

13. A method for producing a unibody mop wringer comprising:

a. designing and building mold tooling of a mop wringer having:

a conical wringer with

1. an open rim adapted to accommodate the head of a round string mop, and

2. a conical compression chamber with sloping sidewalls having an open top and bottom, the open top attached to and in communication with the conical wringer open rim, the sidewalls defining a plurality of equally spaced drain grooves along the inside surface of the conical mop wringer compression chamber sloping sidewalls to assist in water removal, and the bottom having corresponding drain holes aligned beneath the drain grooves along the inside surface of the conical mop wringer compression chamber sloping sidewalls wherein the bottom of the conical wringer is preferably flat and has a diameter approximately one-half the length of the conical compression chamber of the conical wringer, such that as a user forces the head of the mop into the compression chamber water is squeezed out of the mop head through the drain holes, and

3. an integral extended hanger mounting bracket with a front attached proximate the rim of the conical wringer and a hooked rear mounting foot structured to removably mount onto and suspend the mop wringer from a sink divider or wall of a utility or washroom sink between the front and the rear mounting foot, with a snap-on spacer slideably attached to the mounting bracket between the front and rear mounting foot to reduce the distance between the front and the spacer for the bracket to mount on thinner sink divider, and/or utility or washroom sink walls between the front and spacer for a more secure mounting, b. selecting plastic injection material;

c. selecting injection parameters;

d. injection molding the plastic injection material into the mold tooling to form the unibody mop wringer, and e. finishing of parting lines and flash of the unibody mop wringer.

14. A method for producing a unibody mop wringer according to claim 13, wherein the preferred material used for injection is any standard plastic, nylon, or polymer normally used in the industry for such applications where a reasonable degree of strength is required.

* * * * *